US010173451B1

(12) United States Patent
Hsu

(10) Patent No.: US 10,173,451 B1
(45) Date of Patent: Jan. 8, 2019

(54) AUXILIARY BINDING JIG

(71) Applicant: PAO SHEN ENTERPRISES CO., LTD., Chang Hua (TW)

(72) Inventor: Su-Yu Hsu, Chang Hua (TW)

(73) Assignee: PAO SHEN ENTERPRISES CO., LTD., Chang Hua (TW)

( * ) Notice: Subject to any disclaimer, the term of this patent is extended or adjusted under 35 U.S.C. 154(b) by 0 days.

(21) Appl. No.: 15/852,296

(22) Filed: Dec. 22, 2017

(30) Foreign Application Priority Data

Aug. 30, 2017 (TW) ..... 106129481 A

(51) Int. Cl.
*B42B 5/10* (2006.01)

(52) U.S. Cl.
CPC ..... *B42B 5/103* (2013.01)

(58) Field of Classification Search
CPC ... B42B 5/08; B42B 5/103; B42B 5/10; B42F 13/008; B42F 3/04
See application file for complete search history.

(56) References Cited

U.S. PATENT DOCUMENTS 2,910,068 A 10/1959 Lane
4,645,399 A * 2/1987 Scharer ..... B42B 5/08 412/16
5,553,959 A * 9/1996 Feldman ..... B42B 5/08 281/29
5,749,667 A * 5/1998 Feldman ..... B42B 5/08 281/38
5,888,011 A * 3/1999 Reinbold, Jr. ..... B42F 3/003 402/70
6,074,152 A * 6/2000 Vecchi ..... B42B 5/08 412/16
9,266,378 B2 * 2/2016 Cenzano ..... B42D 5/00
D795,344 S * 8/2017 Cenzano ..... D19/32
2004/0240968 A1 * 12/2004 Knight ..... B42B 5/103 412/38
2011/0233913 A1 * 9/2011 Wang ..... B42F 3/003 281/27.2
2013/0071206 A1 * 3/2013 Chiang ..... B42B 5/08 412/38
2013/0257031 A1 * 10/2013 Lai ..... A63H 33/38 281/15.1
2013/0315651 A1 * 11/2013 Levinsohn ..... B42B 5/08 402/4
2018/0065399 A1 * 3/2018 Denys ..... B42F 3/003

* cited by examiner

*Primary Examiner* — Charles A Fox
*Assistant Examiner* — Christopher E Veraa
(74) *Attorney, Agent, or Firm* — Burris Law, PLLC

(57) ABSTRACT

An auxiliary binding jig is configured for assisting a plurality of binding members to bind a plurality of papers into a bound document, and includes an auxiliary plate body having opposite first and second planar surfaces, and a plurality of engaging holes extending through the first and second planar surfaces and each having a constriction which divides a respective engaging hole into two hole portions and which is formed by two press tabs defining therebetween a slot communicating with the hole portions. The press tabs are configured to press against an outer ring of each binding member when each binding member is inserted into a respective engaging hole through the slot so as to position each binding member on the auxiliary plate body.

6 Claims, 20 Drawing Sheets

AUXILIARY BINDING JIG

CROSS-REFERENCE TO RELATED APPLICATION

This application claims priority of Taiwanese Patent Application No. 106129481, filed on Aug. 30, 2017.

FIELD

The disclosure relates to a paper binding tool, more particularly to an auxiliary binding jig.

BACKGROUND

Referring to FIGS. 1 to 3, a plastic binding element 10, as disclosed in U.S. Pat. No. 2,910,068, includes a back plate 11, a plurality of middle fingers 12 and two outer end fingers 13 extending from a long side 111 of the back plate 11, and two T-shaped slots 14 formed in the back plate 11 proximate to the other long side 112 thereof. The middle fingers 12 can be curled to form closed rings. Each outer end finger 13 has a tapered end portion 15 which is notched as at 17 to form a neck 16 in close proximity to the tapered end portion 15. Each T-shaped slot 14 has a base portion 141 and a top portion 142. The base portion 141 has a width slightly greater than the neck 16. The top portion 142 has a width slightly greater than that of each outer end finger 13. The outer end fingers 13 can be curled to form closed rings and inserted into the top portions 142 of the respective T-shaped slots 14. When the neck 16 of each outer end finger 13 enters the base portion 141 of the respective T-shaped slot 14, each outer end finger 13 and the backplate 11 are interlocked. Since the greatest stress is on the outer end fingers 13, the outer end fingers 13 are mechanically interlocked with the back plate 11.

Although the aforesaid plastic binding element 10 can achieve its intended purpose, it has the following drawbacks:

1. The papers 20 to be bound must have binding holes 21 corresponding to the middle fingers 12 and the outer end fingers 13, so that the middle fingers 12 and the outer end fingers 13 can be inserted one by one into the binding holes 21 to thereby bind the papers 20. However, different sizes of papers to be bound usually have different number of binding holes, so that the plastic binding element 10 is not applicable for use in different sizes of papers to be bound.

2. When the papers 20 to be bound do not have binding holes, the user must first use a puncher to punch binding holes 21 into the papers 20 so as to correspond in number to the middle fingers 12 and the outer end fingers 13 of the plastic binding element 10, after which the plastic binding element 10 is used to bind the papers 20. However, if small sized papers 20 are to be bound and only have a few binding holes, the plastic binding element 10 is also not applicable in this case.

SUMMARY

Therefore, an object of the present disclosure is to provide an auxiliary binding jig that can facilitate a user to bind a plurality of papers into a bound document and that is suitable for assisting in binding different sizes of papers to be bound.

Accordingly, an auxiliary binding jig of this disclosure is configured to assist a plurality of binding members for binding a plurality of papers into a bound document. Each binding member has a circular plate and an outer ring connected to an outer periphery of the circular plate. The outer ring has two inner annular surfaces located at two opposite sides of the circular plate. The circular plate has a thickness (t1). The outer ring has a thickness (t2). Each paper has a plurality of binding holes for respectively receiving the outer rings of the binding members, and a plurality of slits respectively communicating with the binding holes. The binding members respectively enter the binding holes through the slits. The auxiliary binding jig comprises an auxiliary plate including an elongated auxiliary plate body and a plurality of engaging holes. The auxiliary plate body has a first planar surface, a second planar surface opposite to the first planar surface, two opposite long sides between the first and second plana surfaces, and two opposite short sides between the long sides and between the first and second planar surfaces. Each long side has a length (L). Each short side has a width (W). The ratio of the length (L) to the width (W) is not less than 2.82:1.

The engaging holes are formed in the auxiliary plate body between the long sides and between the short sides and are configured to receive removably and respectively the binding members. The engaging holes are arranged spaced apart from each other along a length direction of the auxiliary plate body. Each engaging hole extends through the first and second planar surfaces and has a constriction dividing a respective one of the engaging holes into two hole portions spaced apart from each other along a width direction of the auxiliary plate body. The constriction is formed by two press tabs which are spaced apart from each other along the length direction of the auxiliary plate body and which define therebetween a slot communicating with the two hole portions. Each hole portion has a length (h1) measured along the length direction of the auxiliary plate body. The slot has a length (h2) measured along the length direction of the auxiliary plate body. Each press tab has a length (h3) measured along the length direction of the auxiliary plate body. The length (h1) of each hole portion is greater than the thickness (t2) of the outer ring. The length (h2) of the slot is greater than the thickness (t1) of the circular plate but smaller than the thickness (t2) of the outer ring. The length (h3) of each press tab is expressed as $h3=[(t2-t1)/2]\times R$, where R is a value that ranges from 0.7 to 0.95 to limit the length (h3) of each of the press tabs relative to the relationship between the thickness (t1) of the circular plate and the thickness (t2) of the outer ring.

The press tabs of each engaging hole are configured to respectively press against the inner annular surfaces of the outer ring of each binding member when each binding member is inserted into a respective one of the engaging holes through the slot so as to position each binding member on the auxiliary plate body. The auxiliary plate body is configured to be separated from the binding members after the papers to be bound are connected to the binding members by pulling each binding member away from the respective one of the engaging holes.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 16:
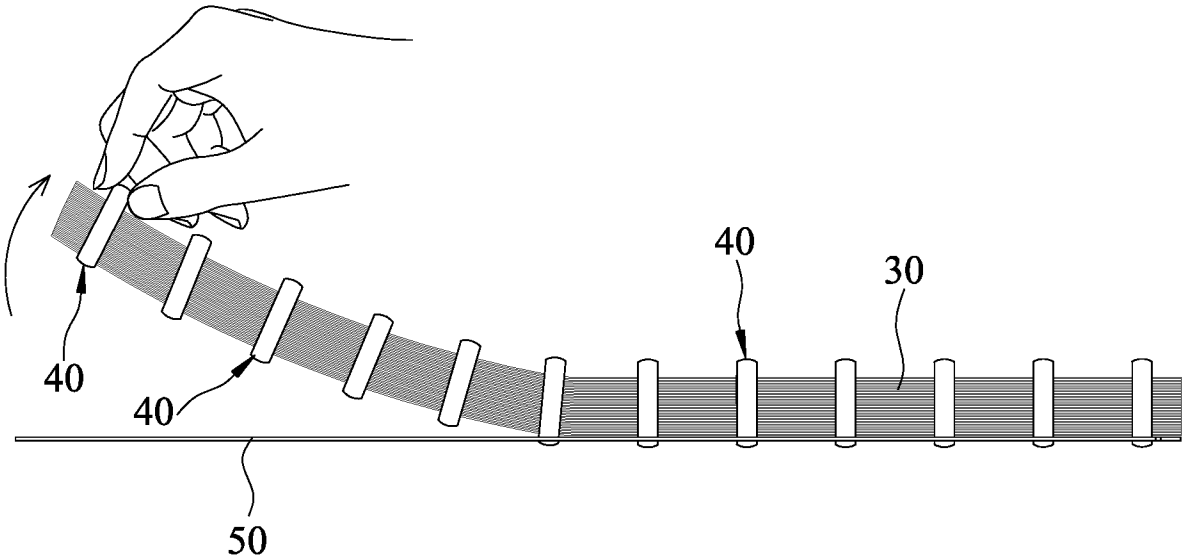
FIG. 16 is a schematic side view, illustrating how the binding members are pulled away from an auxiliary plate of the auxiliary binding jig of the embodiment.
Figure 17:
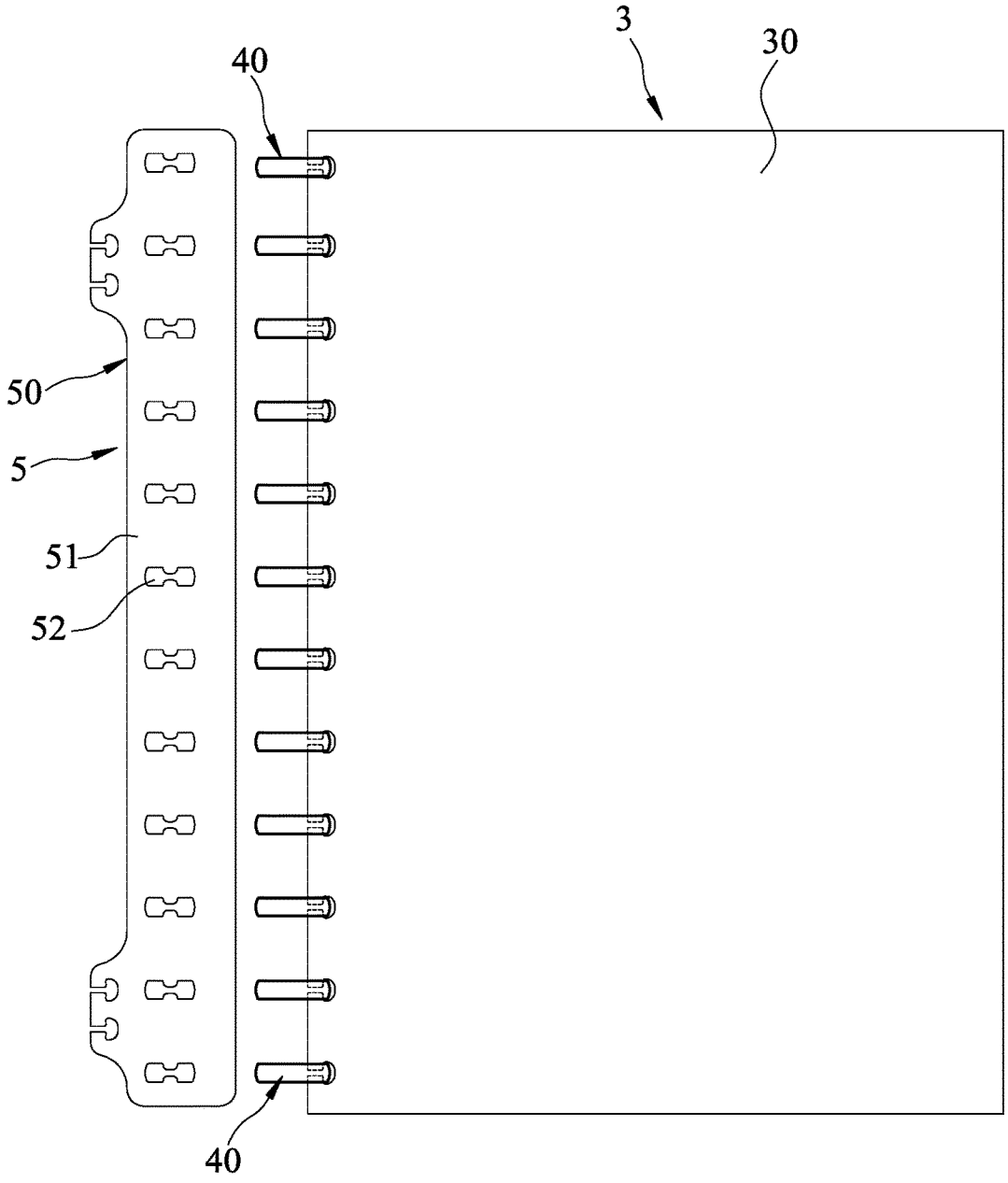
FIG. 17 is a view similar to FIG. 15, but with the binding members being removed from the auxiliary plate and the papers being bound by the binding members.

Referring to FIG. 17, an auxiliary binding jig 5 according to the embodiment of the present disclosure is configured to assist a plurality of binding members 40 for binding a plurality of papers 30 (see FIG. 16) into a bound document 3, such as a book or notebook.

Figure 14:
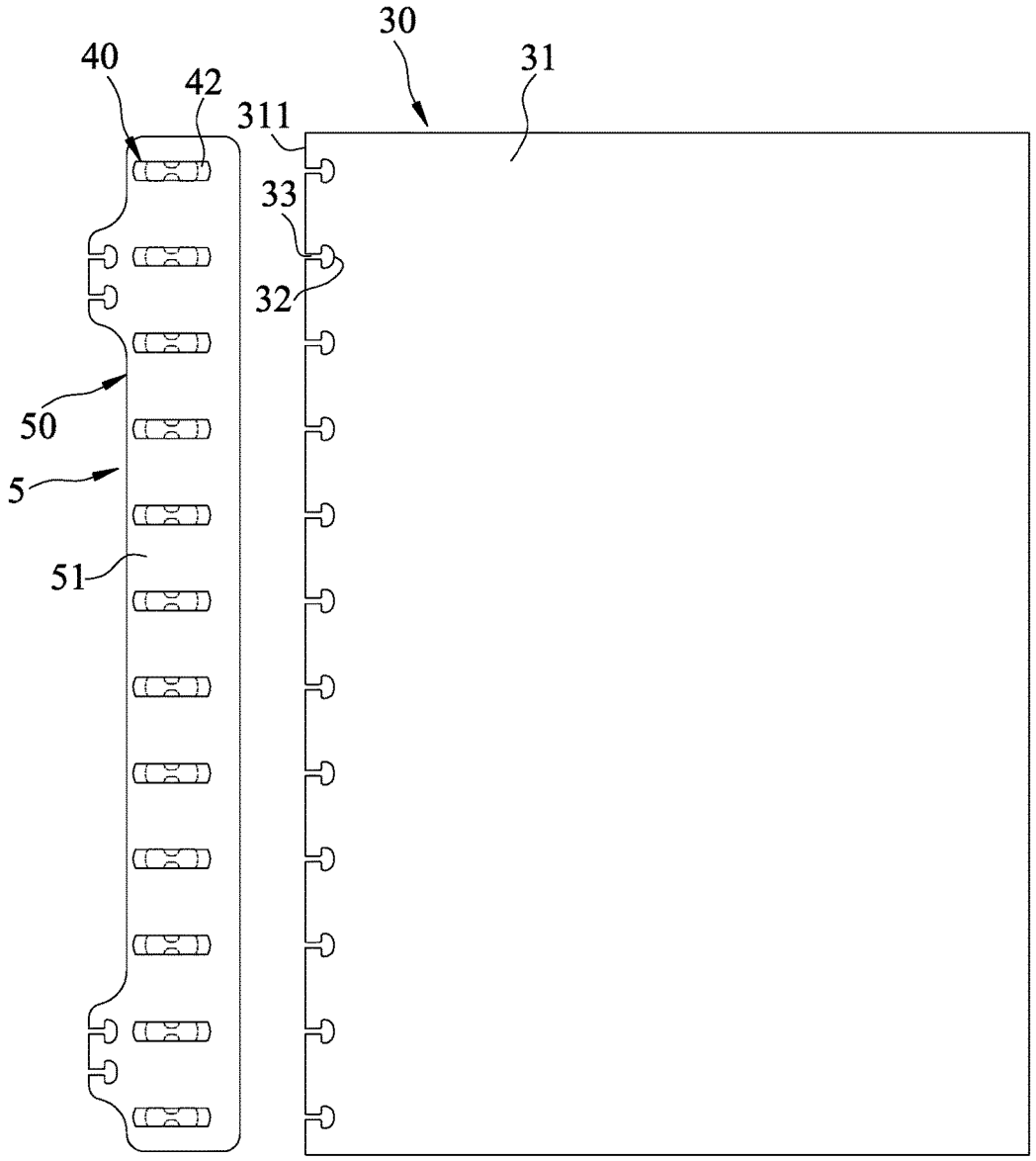
FIG. 14 is a schematic top view, illustrating the embodiment with the assembled binding members and a plurality of papers to be bound prior to connection with the binding members.
Figure 15:
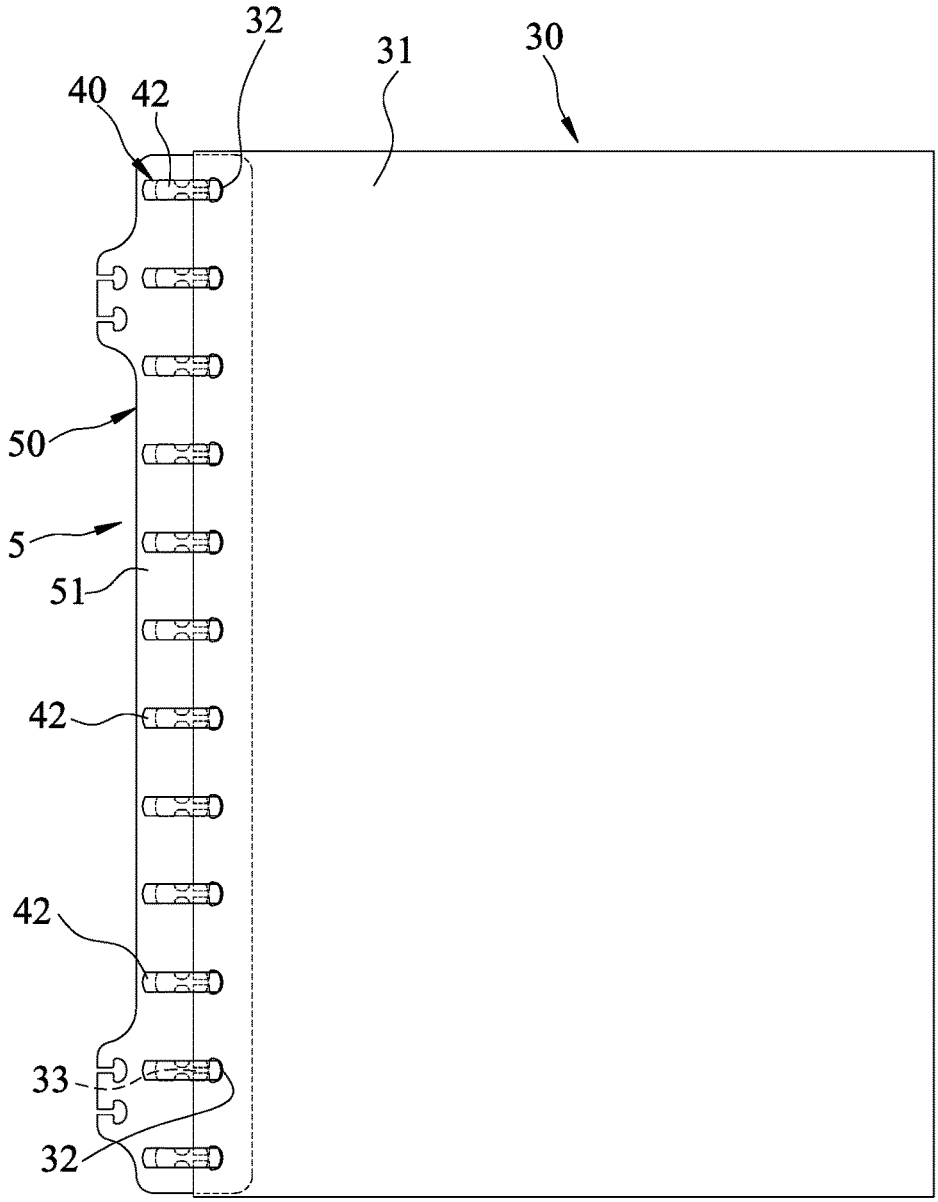
FIG. 15 is a view similar to FIG. 14, but illustrating the papers being connected to the binding members.

Referring to FIG. 14, each of the papers 30 has a main body 31, a plurality of binding holes 32 formed in the main body 31 in proximity to one side 311 thereof, and a plurality of slits 33 formed in the side 311 thereof and respectively communicating with the binding holes 32. The common sizes of the papers 30 to be bound are A4 (297 mm×210 mm), A5 (210 mm×148 mm), A6 (148 mm×105 mm), A7 (74 mm×105 mm), B5 (250 mm×176 mm), standard letter (11"×8.5"), junior letter (8.5"×5.5"), jotter (3"×5"), and index card (5"×3"). Before binding, the papers 30 are first punched with predetermined number of binding holes 32 and slits 33 using a hole puncher (not shown).

Figure 6:
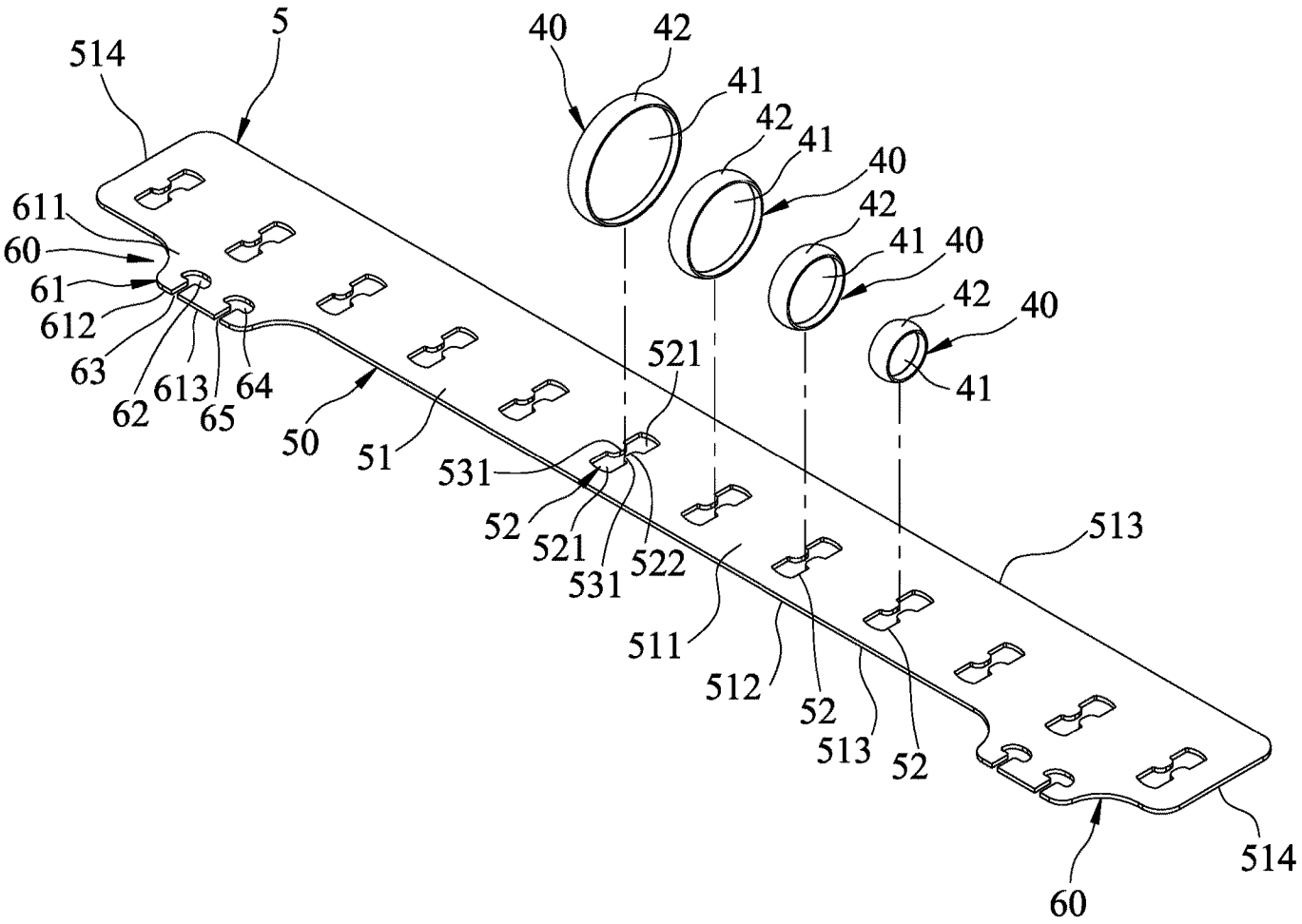
FIG. 6 is an exploded perspective view of the embodiment and binding members of different sizes.
Figure 7:
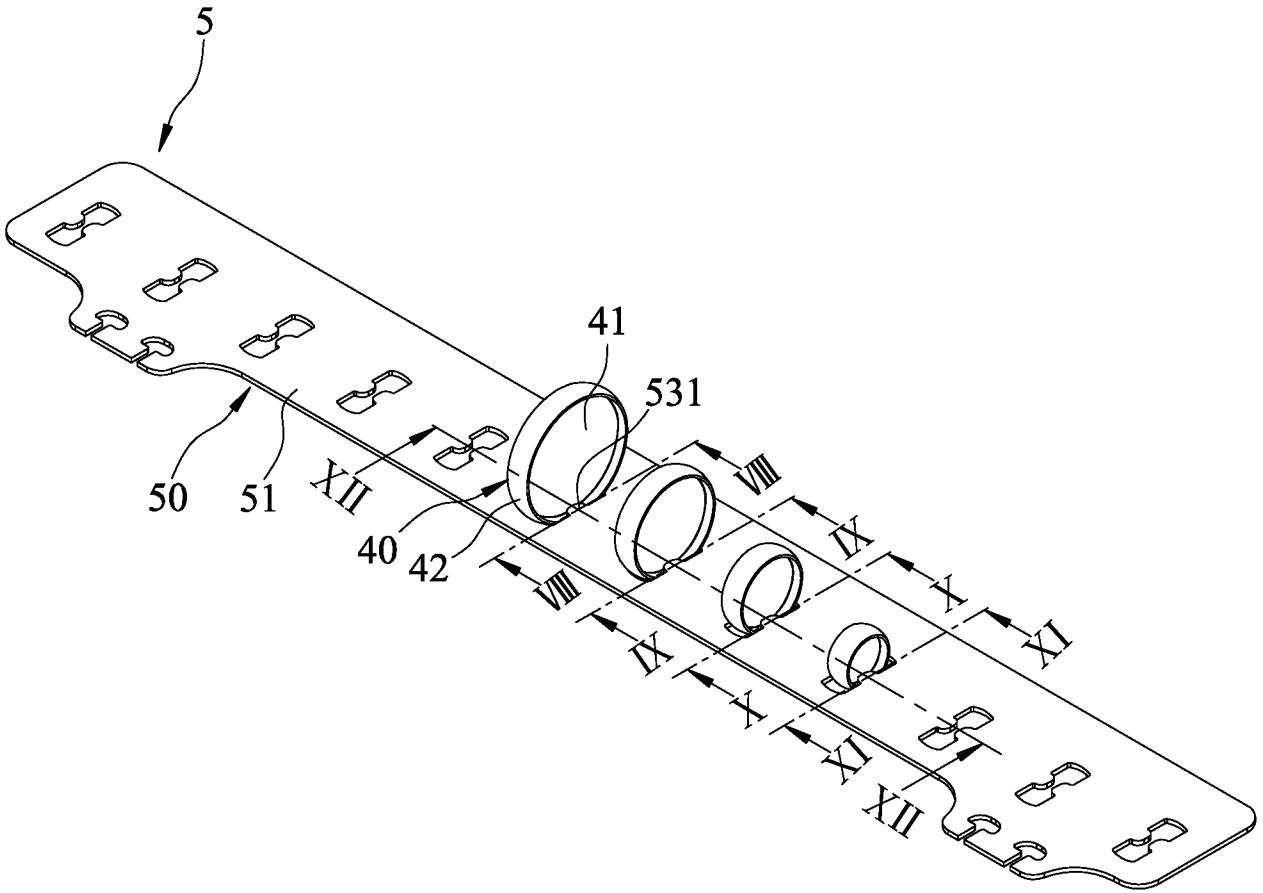
FIG. 7 is an assembled perspective view of FIG. 6.
Figure 8:
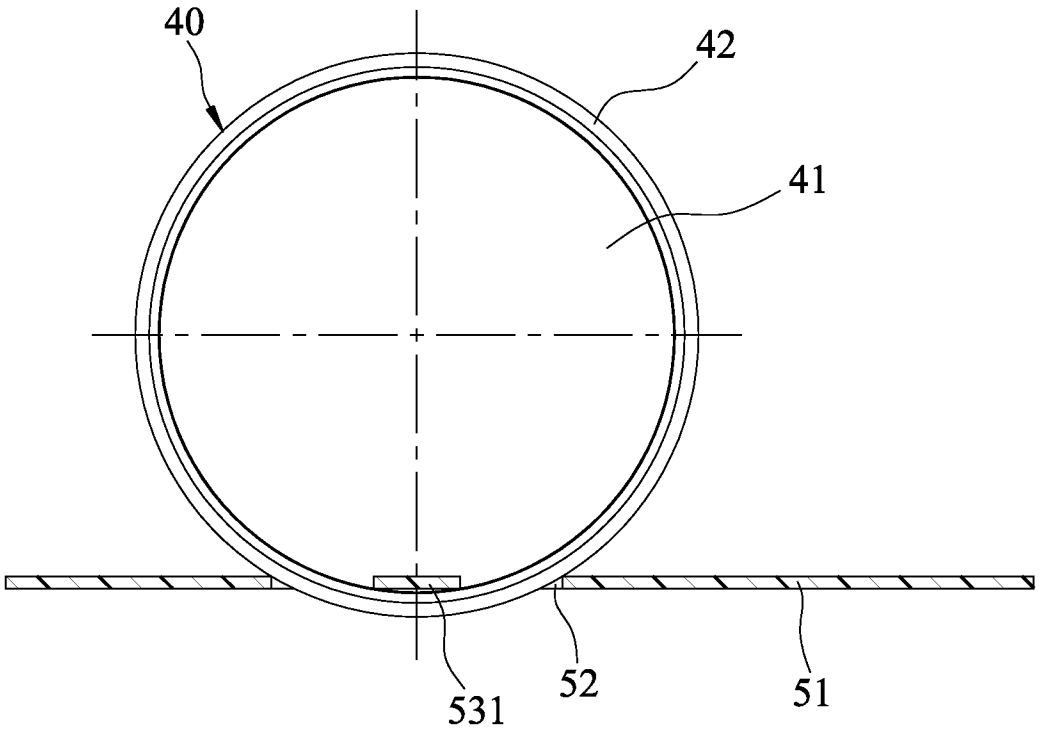
FIG. 8 is a sectional view taken along line VIII-VIII of FIG. 7.
Figure 9:
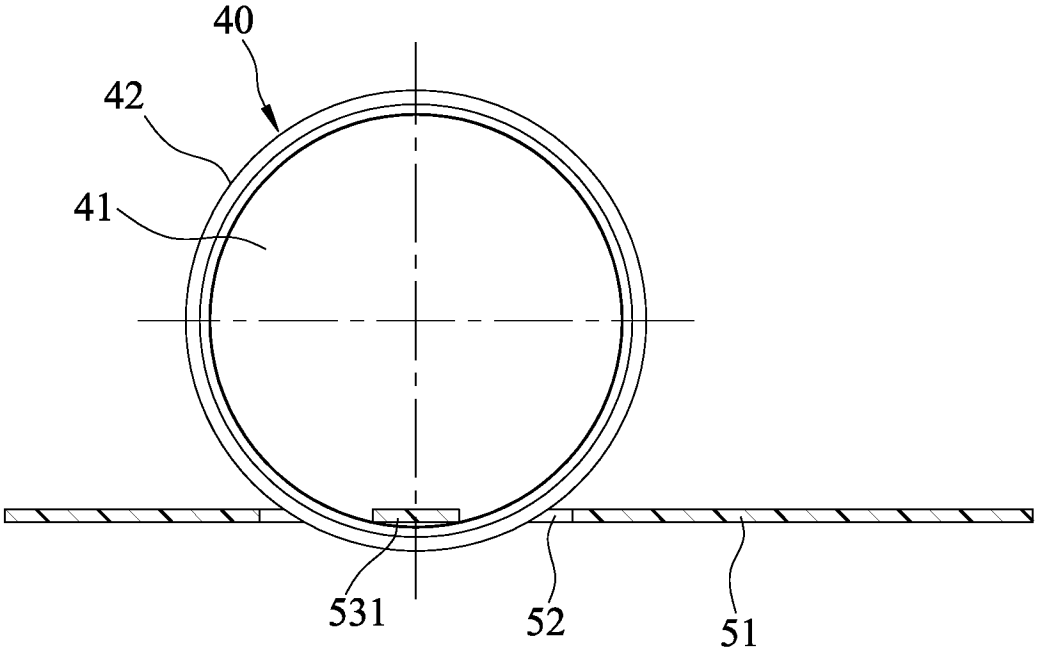
FIG. 9 is a sectional view taken along line IX-IX of FIG. 7.
Figure 10:
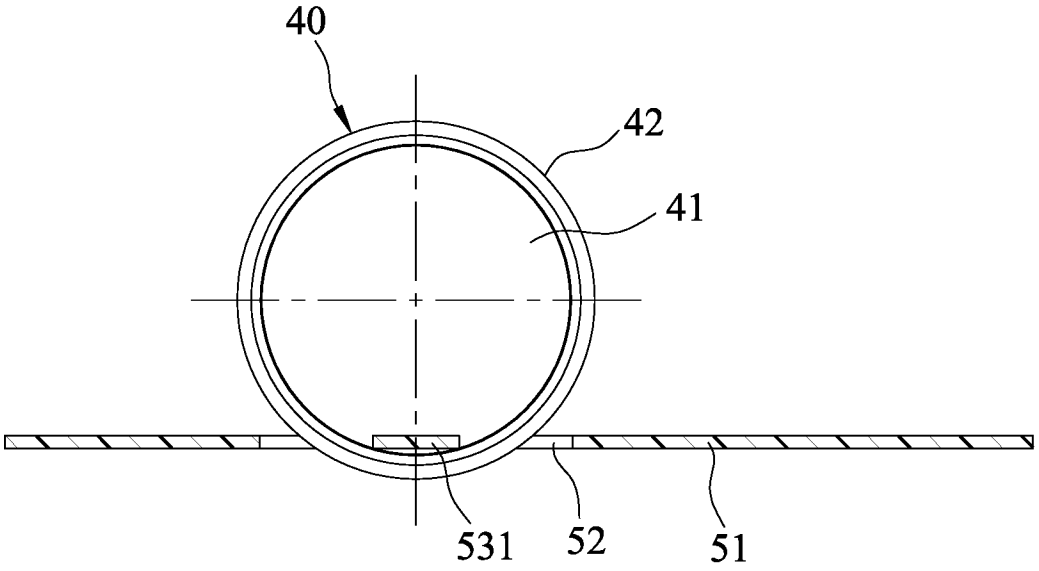
FIG. 10 is a sectional view taken along line X-X of FIG. 7.
Figure 12:
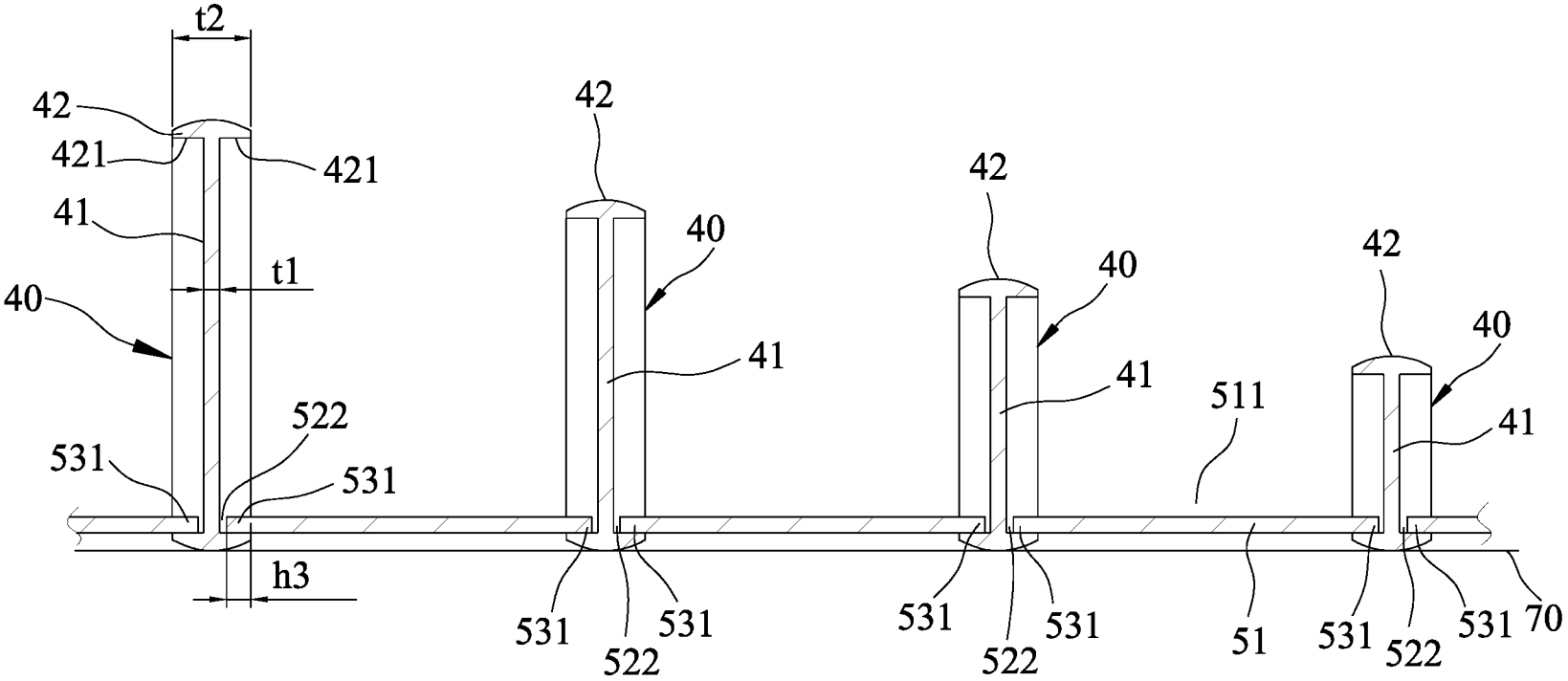
FIG. 12 is a sectional view taken along line XII-XII of FIG. 7.
Figure 13:
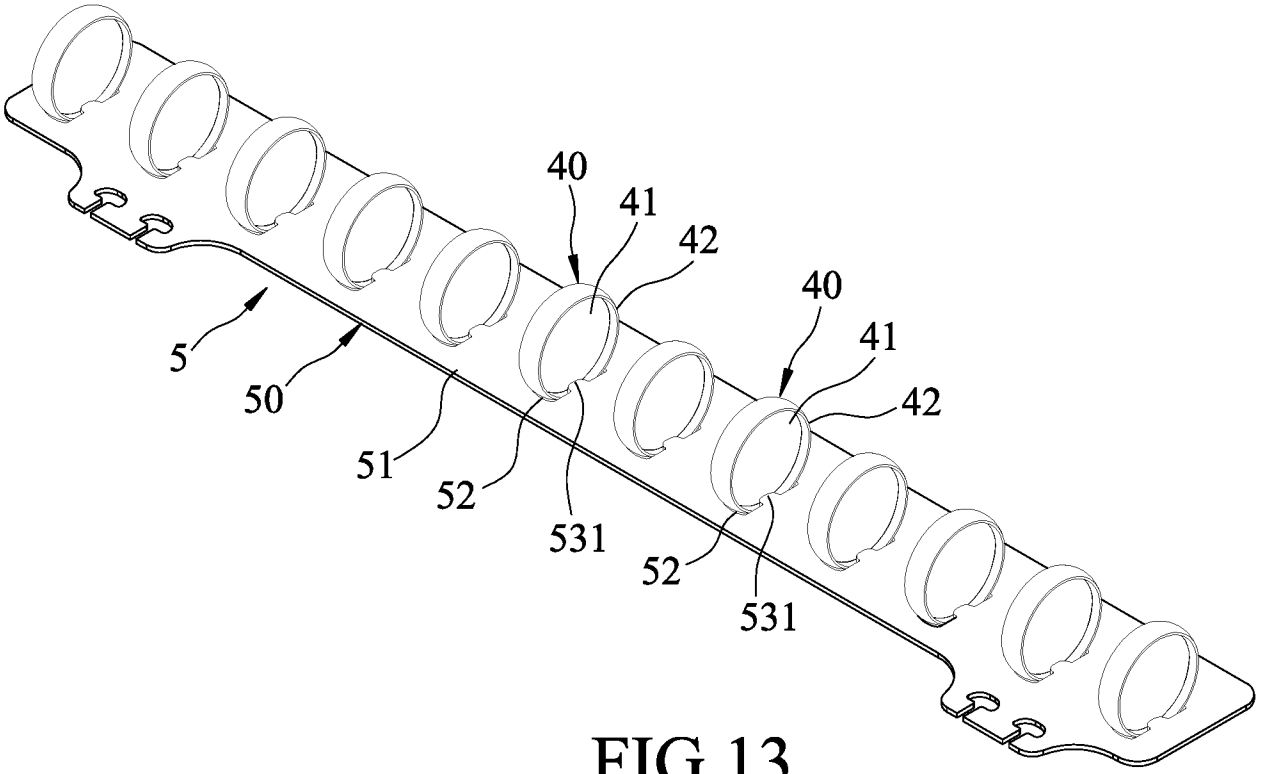
FIG. 13 is an assembled perspective view of the embodiment and binding members of same sizes.

Referring to FIGS. 6, 7 and 12, each of the binding members 40 has a flat circular plate 41, and an outer ring 42 integrally connected to an outer periphery of the circular plate 41 and having two inner annular surfaces 421 located at two opposite sides of the circular plate 41. The circular plate 41 has a thickness (t1), while the outer ring 42 has a thickness (t2) greater than the thickness (t1) of the circular plate 41. The binding holes 52 of each paper 30 can receive respectively and removably the outer rings of the binding members 40. The binding members 40 may have different sizes. That is, the binding members 40 may have different diameters (for example, 10 mm, 15 mm, 20 mm, 25 mm), but the thickness (t1) of the circular plates 41 of the binding members 40 may be the same, and the thickness (t2) of the outer rings 42 of the binding members 40 may be the same. Through this, a user can select an appropriate size of the binding member 40 according to the number of the papers 30 to be bound. If many papers 30 are to be bound, the binding member 40 having the circular plate 41 with a large diameter is selected; and, if less paper 30 is to be bound, the binding member 40 having the circular plate 41 with a small diameter is selected.

Figure 1:
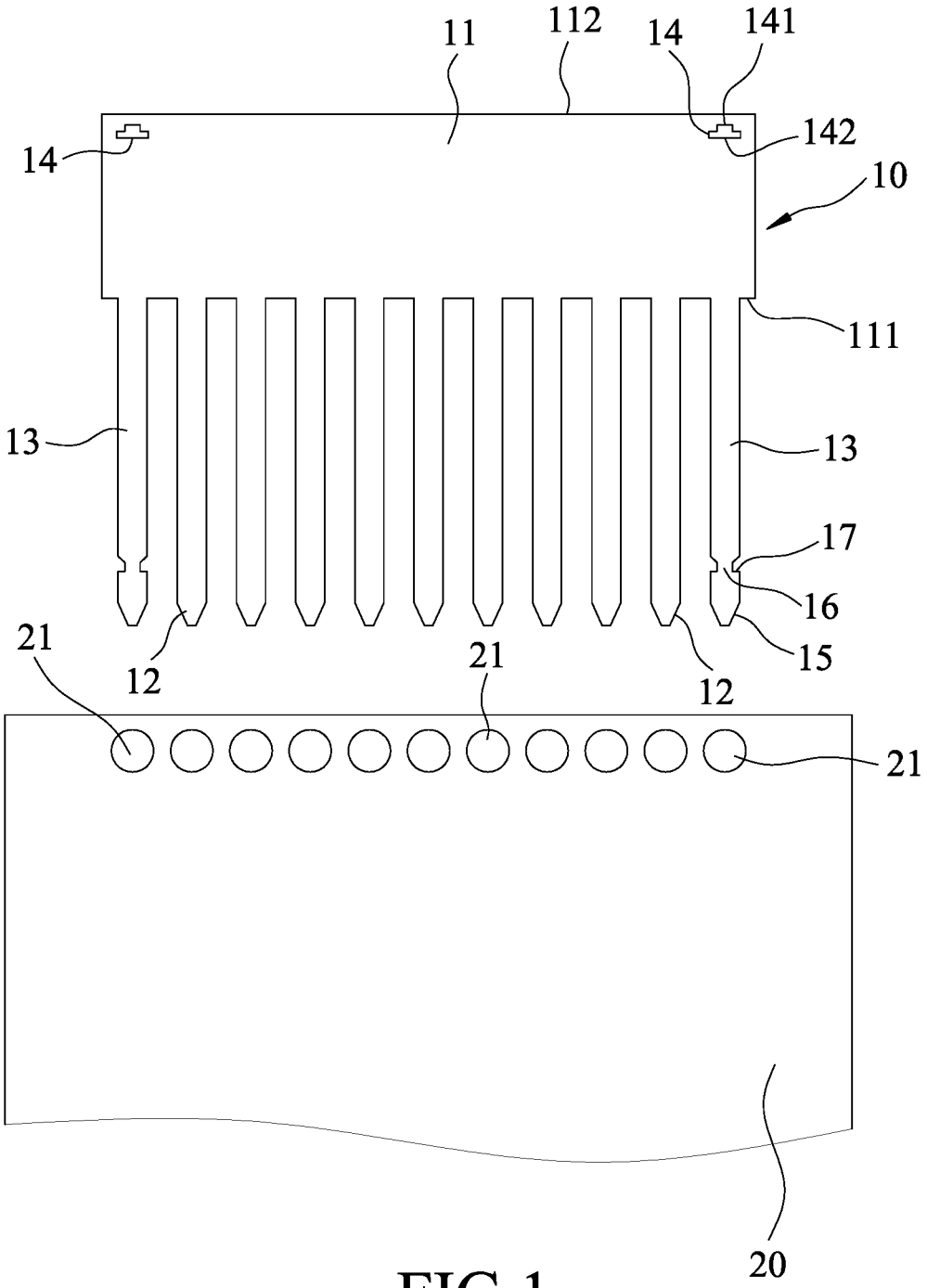
FIG.1 PRIOR ART
FIG. 1 is a schematic view of a plastic binding element disclosed in U.S. Pat. No. 2,910,068.
Figure 2:
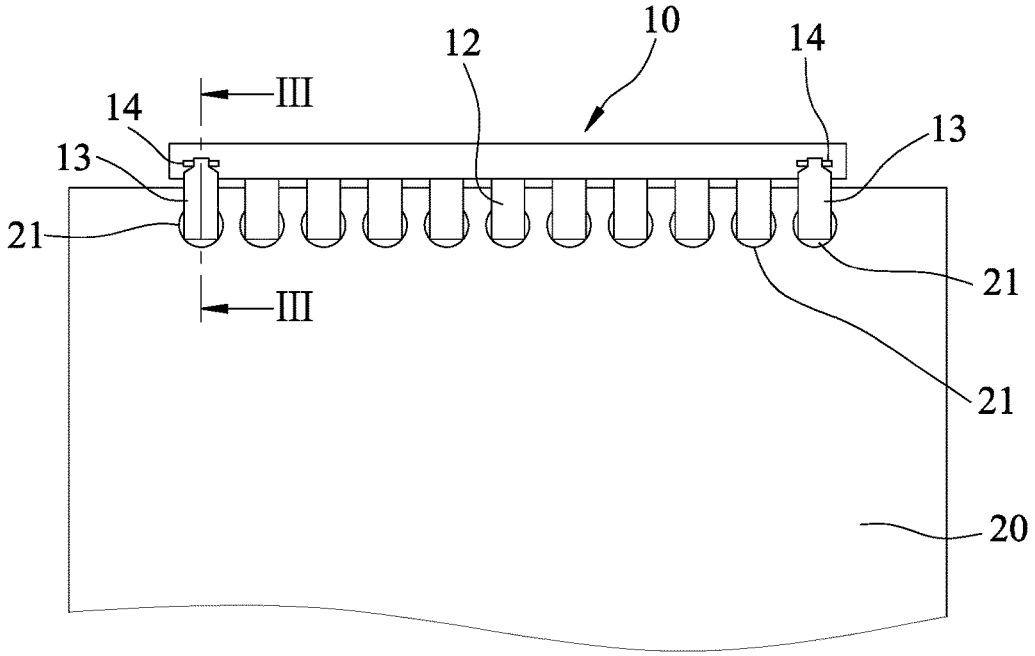
FIG.2 PRIOR ART
FIG. 2 illustrates the plastic binding element of FIG. 1 in a state of use.
Figure 3:
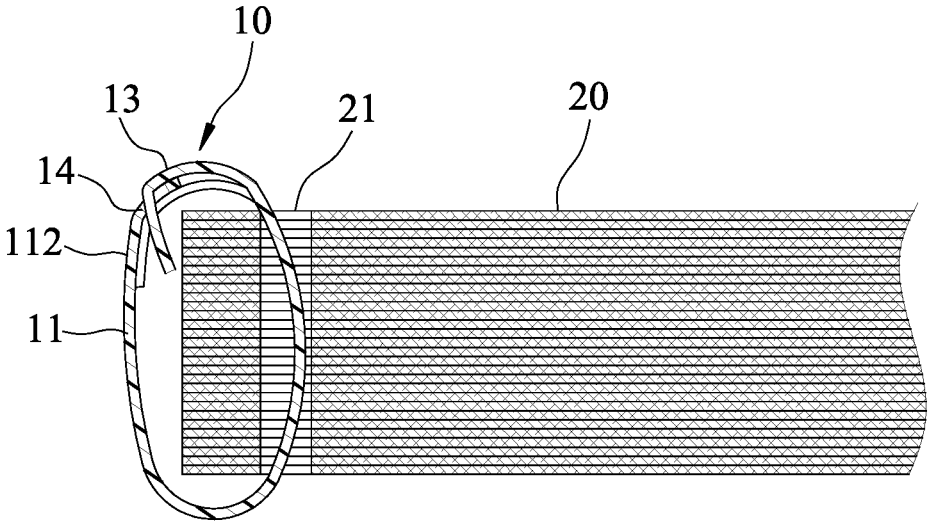
FIG.3 PRIOR ART
FIG. 3 is a sectional view taken along line III-III of FIG. 2.
Figure 4:
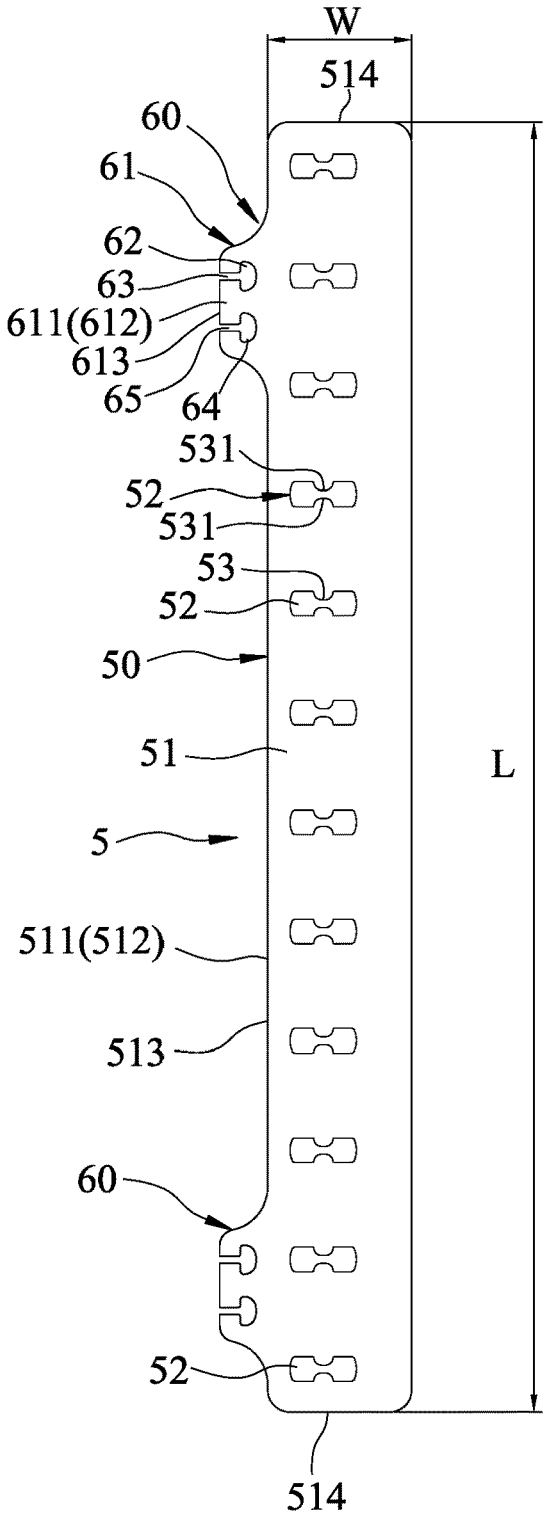
FIG. 4 is a schematic top view of an auxiliary binding jig according to the embodiment of this disclosure.
Figure 5:
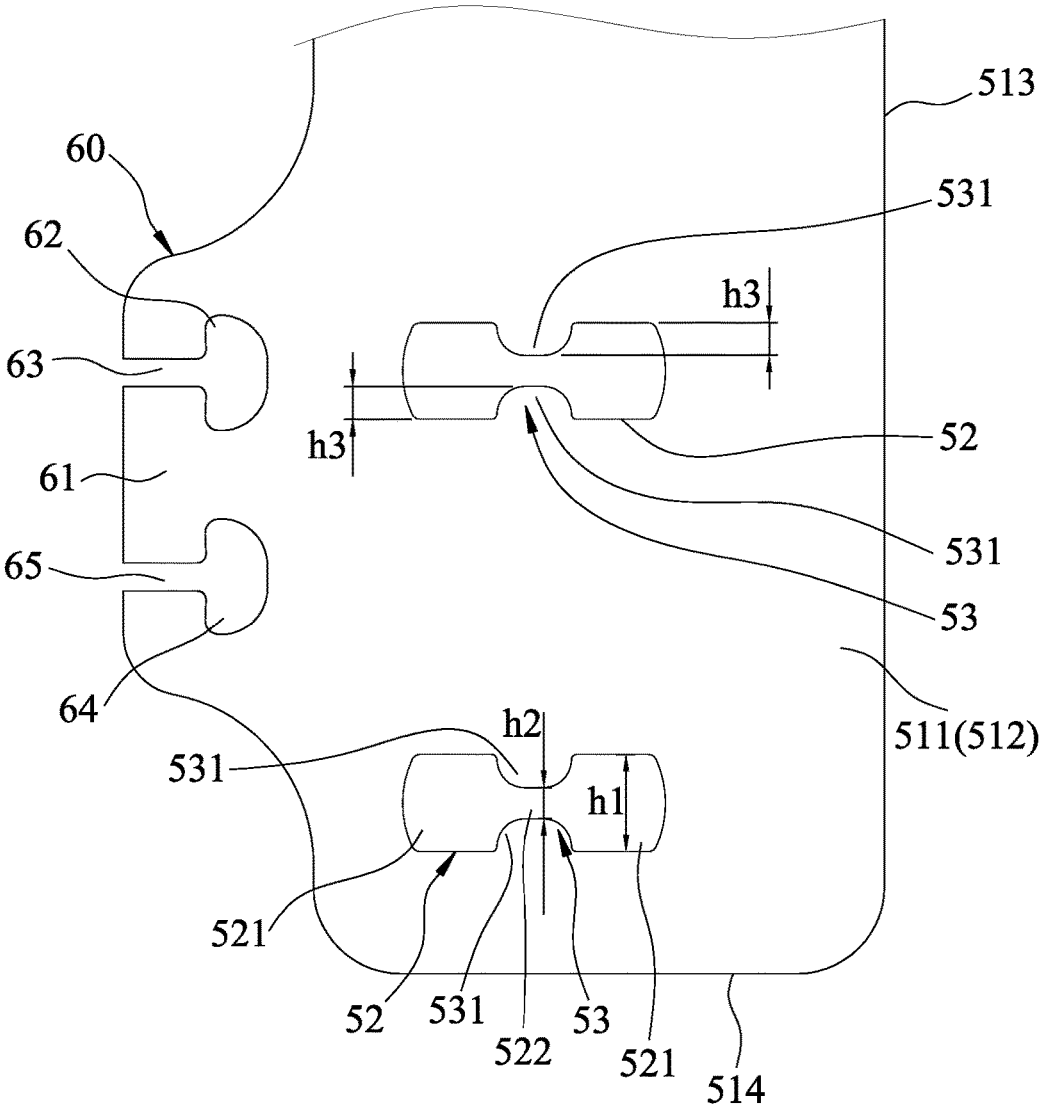
FIG. 5 is an enlarged fragmentary schematic view of the embodiment.

Referring to FIGS. 4 and 5, in combination with FIG. 6, the auxiliary binding jig 5 of this embodiment includes an auxiliary plate 50 and a plurality of connecting plates 60. The auxiliary binding jig 5 is flexible. In this embodiment, the auxiliary binding jig 5 is made of plastic, but is not limited thereto. The auxiliary binding jig 5 may also be made of other flexible materials.

The auxiliary plate 50 includes an elongated auxiliary plate body 51 and a plurality of engaging holes 52. The auxiliary plate body 51 has a substantially rectangular shape, and has a first planar surface 511, a second planar surface 512 opposite to the first planar surface 511, two opposite long sides 513 between the first and second planar surfaces 511, 512, and two opposite short sides 514 between the long sides 513 and between the first and second planar surfaces 511, 512. Each long side 513 has a length (L). Each short side 514 has a width (W). In this embodiment, the ratio of the length (L) to the width (W) is not less than 2.82:1.

The engaging holes 52 are formed in the auxiliary plate body 51 between the long sides 513 and between the short sides 514, and are configured to receive removably and respectively the binding members 40. The engaging holes 52 are arranged spaced apart from each other along a length direction of the auxiliary plate body 51. Each engaging hole 52 extends through the first and second planar surfaces 511, 512, and has a constriction 53 dividing a respective one of the engaging holes 52 into two hole portions 521 spaced apart from each other along a width direction of the auxiliary plate body 51. The constriction 53 is formed by two press tabs 531 which are spaced apart from each other along the length direction of the auxiliary plate body 51 and which define therebetween a slot 522 communicating with the two hole portions 521.

As shown in FIG. 5, each hole portion 521 has a length (h1) measured along the length direction of the auxiliary plate body 51, the slot 522 has a length (h2) measured along the length direction of the auxiliary plate body 51, and each press tab 531 has a length (h3) measured along the length direction of the auxiliary plate body 51.

With reference to FIGS. 5 to 7 and 12, in order for the binding members 40 of different sizes to be easily engaged with and positioned in the engaging holes 52, respectively, or to be easily pulled out and disengaged from the respective engaging holes 52, the length (h1) of each hole portion 521 of each engaging hole 52 is slightly greater than the thickness (t2) of the outer ring 42 of each binding member 40, and the length (h2) of the slot 522 of each engaging hole 52 is slightly greater than the thickness (t1) of the circular plate 41 but smaller than the thickness (t2) of the outer ring 42 of each binding member 40. Specifically, the length (h3) of each press tab 531 is expressed as $h3=[(t2-t1)/2]\times R$, where R is a value that ranges from 0.7 to 0.95 to limit the length (h3) of each press tab 531 relative to the relationship between the thickness (t1) of the circular plate 41 and the thickness (t2) of the outer ring 42. Through this relationship, the different sizes of the binding members 40 can be easily positioned in and can be easily removed from the respective engaging holes 52. After each binding member 40 is inserted into the respective engaging hole 52 through the slot 522, the press tabs 531 are respectively pressed against the inner annular surfaces 421 of the outer ring 42 so as to position each binding member 40 in the respective engaging hole 52, so that each binding member 40 will not disengage from the respective engaging hole 52 under normal circumstances.

Because the thickness (t2) of the outer ring 42 of each binding member 40 is greater than the length (h2) of the slot 522 of the respective engaging hole 52, which is also the distance between the two press tabs 531, during insertion of each binding member 40 into the respective engaging hole 52, a force must be exerted to push the outer ring 42 through the press tabs 531. Since the auxiliary binding jig 5 is flexible, as the outer ring 42 moves through the press tabs 531, the press tabs 531 are bent and deformed by the outer ring 42. After the outer ring 42 passes through the press tabs 531, the press tabs 531 are automatically restored to their original positions and are pressed against the respective inner annular surfaces 421 of the outer ring 42, thereby positioning each binding member 40 in the respective engaging hole 52. Based on the same principle, each binding member 40 can also be pulled out and disengaged from the respective engaging hole 52.

Figure 11:
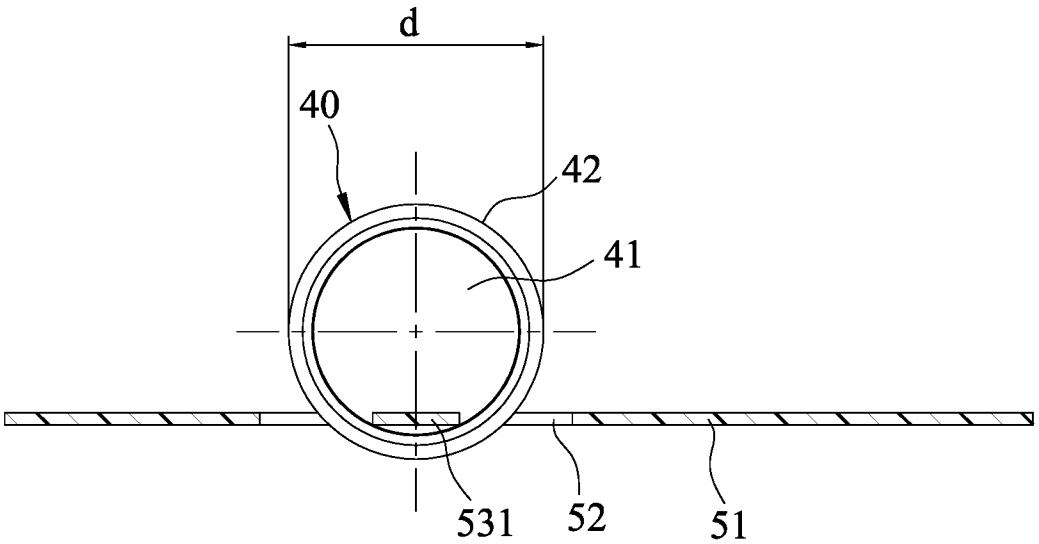
FIG. 11 is a sectional view taken along line XI-XI of FIG. 7.

With reference to FIGS. 4 and 7 to 12, because the two press tabs 531 of each engaging hole 52 are used to block and press against the outer ring 42 of the respective binding member 40, regardless of the size relationship between a width (d) of the engaging hole 52 measured in the width direction of the auxiliary plate body 51 and an outer diameter of the outer ring 42, it will not affect the effect of positioning each binding member 40 in the respective engaging hole 52. As shown in FIG. 11, even if the outer diameter of the outer ring 42 of the binding member 40 is smaller than the width (d) of the engaging hole 52, the binding member 40 will not disengage from the engaging hole 52 under normal circumstances. Moreover, during the binding operation, the auxiliary binding jig 5 and the binding members 40 are usually placed on a table 70 (see FIG. 12), and after assembly, the binding members 40 protrude from the first planar surface 511 of the auxiliary plate body 51 to facilitate smooth operation of binding.

Referring again to FIGS. 4 to 6, the connecting plates 60 extend from one of the long sides 513 of the auxiliary plate body 51 in a direction away from the other long side 513, and are spaced apart from each other along the length direction of the auxiliary plate body 51. Each connecting plate 60 has an elongated connecting plate body 61, and a first connecting hole 62, a first slit 63, a second connecting hole 64 and a second slit 65 all formed in the connecting plate body 61. The connecting plate body 61 has first and second planar surfaces 611, 612 respectively flush with the first and second planar surfaces 511, 512 of the auxiliary plate body 51, and a connecting side 613 between the first and second planar surfaces 611, 612 and distal from the auxiliary plate body 51. Each of the first and second connecting holes 62, 64 has a substantially semicircular shape, and extends through the first and second planar surfaces 611, 612. The first and second connecting holes 62, 64 are spaced apart from each other along a length direction of the connecting plate body 61 which is parallel to the length direction of the auxiliary plate body 51. The first slit 63 is formed in the connecting side 613, communicates with the first connecting hole 62, and has a length measured along the length direction of the connecting plate body 61 smaller than a diameter of the first connecting hole 62. The second slit 65 is also formed in the connecting side 613, communicates with the second connecting hole 64, and has a length measured along the length direction of the connecting plate body 61 smaller than a diameter of the second connecting hole 64. A distance between the first and second connecting holes 62, 64 is not less than 3 mm to maintain the structural strength of the connecting plate 60.

Although two connecting plates 60 are illustrated in the figures of this embodiment, the number of the connecting plate 60 is not limited thereto.

Referring to FIGS. 13 to 17, in use, the auxiliary binding jig 5 is first placed on the table 70 (see FIG. 12), and the binding members 40 of appropriate sizes are selected based on the size and quantity of the papers 30 to be bound. Next, the selected binding members 40 are assembled on the auxiliary plate 50 by positioning the binding members 40 in the respective engaging holes 52. Afterwards, the slits 33 in the papers 30 to be bound are respectively aligned with the outer rings 42 of the binding members 40, and a force is exerted on the papers 30 to be bound so as to push the slits 33 against the outer rings 42 and permit entry of the outer rings 42 into the respective binding holes 32 of the papers 30 to be bound. Since the length of each slit 33 is smaller than the thickness (t2) of the outer ring 42 of the respective binding member 40, the outer ring 42 of each binding member 40 cannot pass through the respective slit 33 under normal circumstances. At this time, the binding members 40 are connected to the papers 30. Finally, the auxiliary plate 50 can be pressed by one hand of the user, while the other hand of the user can grasp one of the binding members 40 and pulls the same away from the auxiliary plate 50 to disengage from the respective engaging hole 52. After all the binding members 40 are removed from the respective engaging holes 52, the binding members 40 are connected to the papers 30, thereby binding the papers 30 into a bound document 3. In this embodiment, the bound document 3 is a notebook.

Although twelve (12) binding members 40 are exemplified in this embodiment, the number and position of the binding members 40 may be adjusted according to the actual requirement of the user.

Figure 18:
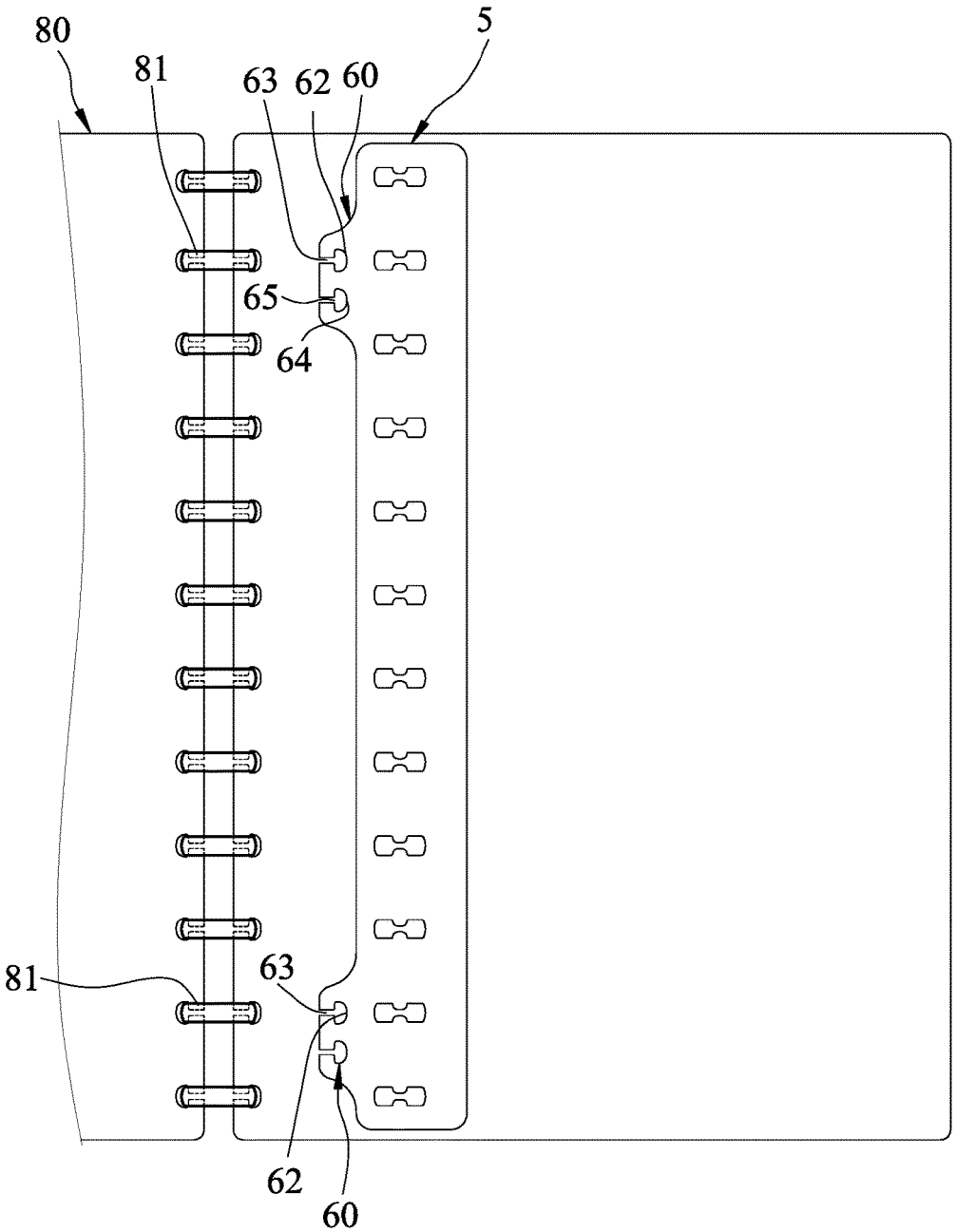
FIG. 18 is a schematic top view, illustrating how the embodiment can be connected to a notebook.
Figure 19:
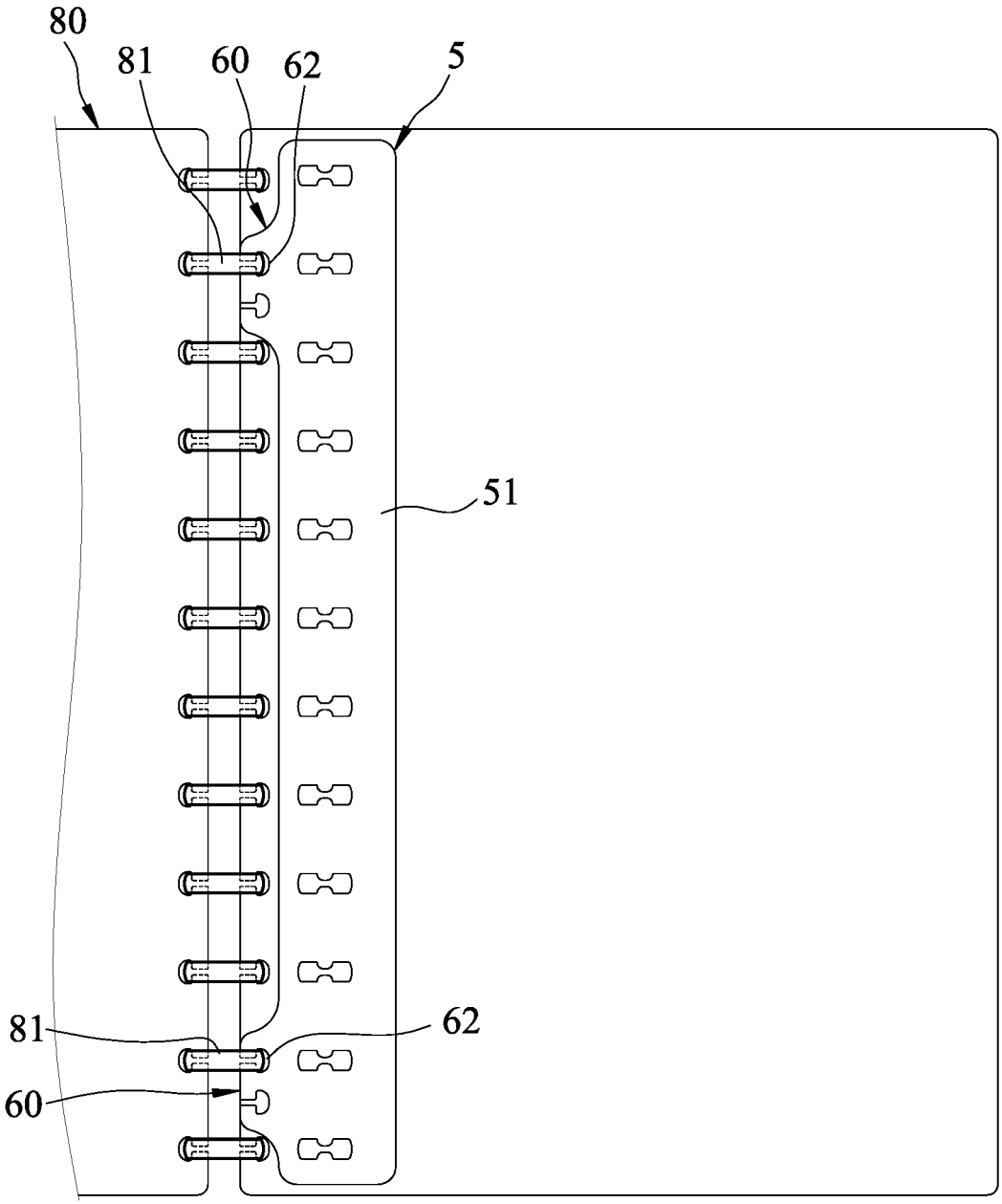
FIG. 19 is a view similar to FIG. 18, but with the embodiment being connected to the notebook.

Referring to FIGS. 18 and 19, the auxiliary binding jig 5 of this disclosure may be placed in a notebook 80 to facilitate the carrying and storing thereof. By aligning and pushing the first slits 63 of the connecting plates 60 with and against the corresponding binding rings 81 of the notebook 80 to permit entry of the binding rings 81 of the notebook 80 into the corresponding first connecting holes 62 of the connecting plates 60, the connecting plates 60 can be engaged to the corresponding binding rings 81. Under normal circumstances, the auxiliary binding jig 5 will not separate from the notebook 80. When use of the auxiliary binding jig 5 is necessary, the auxiliary plate 50 is pulled to disengage the connecting plates 60 from the corresponding binding rings 81, thereby separating the auxiliary binding jig 5 from the notebook 80.

Figure 20:
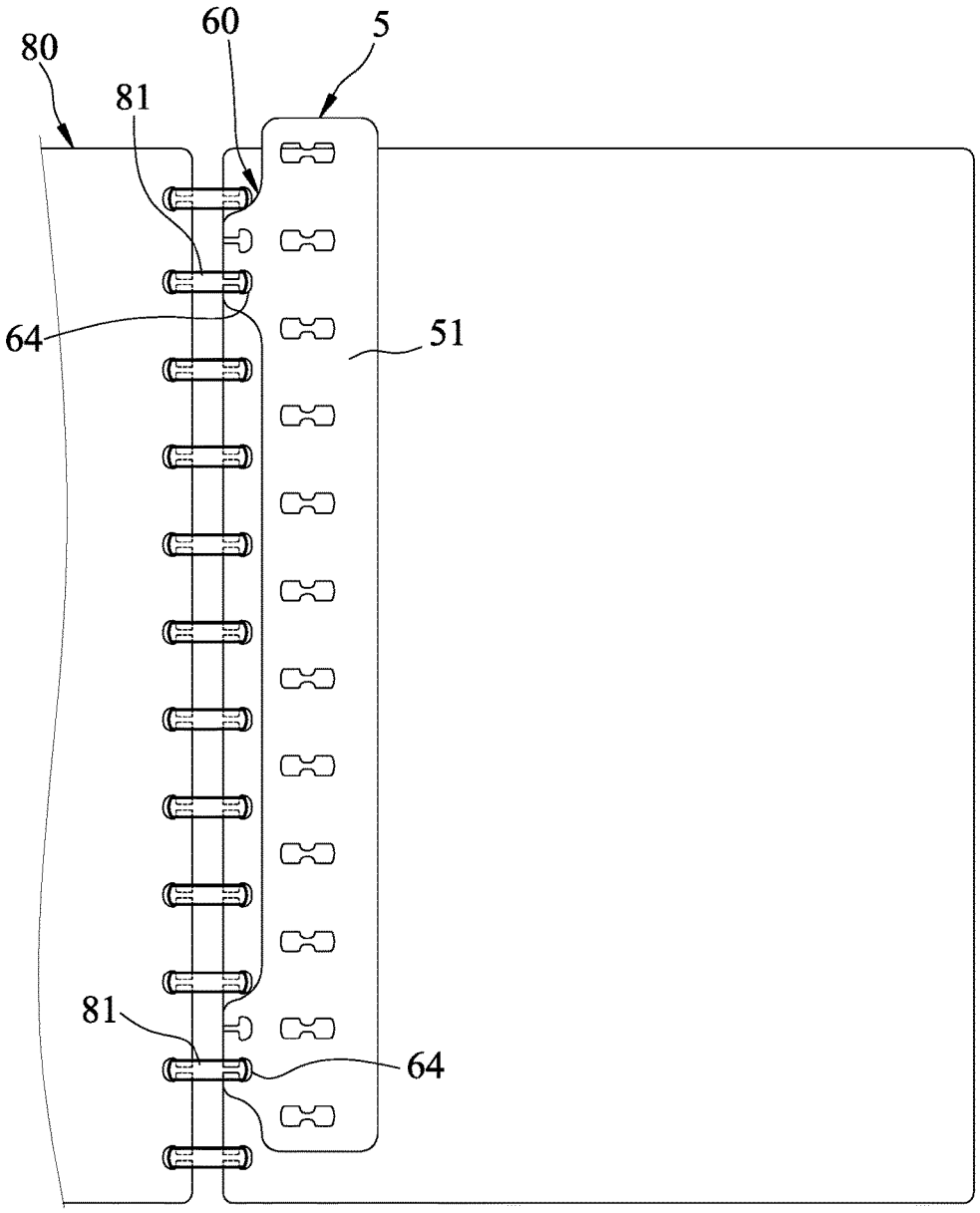
FIG. 20 is a view similar to FIG. 19, but with second connecting holes of connecting plates of the embodiment being connected to corresponding two of binding rings of the notebook.

Referring to FIG. 20, in combination with FIG. 18, the auxiliary binding jig 5 of this disclosure may also serve as a bookmark. In this case, the second slits 65 of the connecting plates 60 are aligned with and pushed against the corresponding binding rings 81 to permit entry of the binding rings 81 into the corresponding second connecting holes 64 of the connecting plates 60, thereby engaging the connecting plates 60 to the corresponding binding rings 81. At this time, a portion of the auxiliary plate 51 protrudes out of the notebook 80 to produce the effect of a bookmark.

Further, a ruler may be printed on the first or second planar surface 511, 512 of the auxiliary plate 51, so that the auxiliary binding jig 5 can simultaneously have a measuring effect.

In sum, the auxiliary binding jig 5 of this disclosure has the following advantages and effects:

1. A user can use the auxiliary binding jig 5 to bind a plurality of papers 30 into a bound document 3 by himself or herself, so that the auxiliary binding jig 5 is relatively convenient to use.

2. The auxiliary binding jig 5 can permit positioning of the binding members 40 with different sizes thereon. Based on the sizes and quantity of papers 30 to be bound, a user can select appropriate sizes of the binding members 40 to be used. Through the auxiliary binding jig 5, a plurality of paper 30 can be combined with the appropriate binding members 40 so as to be bound into a bound document 3, such as a book or notebook. Hence, the auxiliary binding jig 5 is suitable for use in binding papers 30 of different sizes.

3. A user can punch a plurality of binding holes 32 and slits 33 into the papers 30 to be bound according to his/her requirement, after which appropriate sizes of the binding members 40 are selected. The auxiliary binding jig 5 is then use to engage the binding members 40 with the binding holes 32 of the papers 30 so as to bind the papers 30 into a bound document 3. The binding operation is relatively easy and can save time. Further, the auxiliary binding jig 5 can meet the binding requirement of the user.

4. The auxiliary binding jig 5 can be combined with the notebook 80 through the connecting plates 60 so as to facilitate the carrying and storing thereof.

5. The auxiliary binding jig 5 can serve as a bookmark through engagement of the second connecting holes 64 of the connecting plates 60 with the corresponding binding rings 81 of the notebook 80.

Therefore, the object of this disclosure can indeed be achieved.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An auxiliary binding jig for assisting a plurality of binding members to bind a plurality of papers into a bound document, each of the binding members having a circular plate and an outer ring connected to an outer periphery of the circular plate, the outer ring having two inner annular surfaces located at two opposite sides of the circular plate, the circular plate having a thickness (t1), the outer ring having a thickness (t2), each of the paper shaving a plurality of binding holes for respectively receiving the outer rings of the binding members, and a plurality of slits respectively communicating with the binding holes, the binding members respectively entering the binding holes through the slits, said auxiliary binding jig comprising:

an auxiliary plate including an elongated auxiliary plate body having a first planar surface, a second planar surface opposite to said first planar surface, two opposite long sides between said first and second planar surfaces, and two opposite short sides between said long sides and between said first and second planar surfaces, each of said long sides having a length (L), each of said short sides having a width (W), the ratio of said length (L) to said width (W) being not less than 2.82:1; and a plurality of engaging holes formed in said auxiliary plate body between said long sides and between said short sides and configured to receive removably and respectively the binding members, said engaging holes being arranged spaced apart from each other along a length direction of said auxiliary plate body, each of said engaging holes extending through said first and second planar surfaces and having a constriction dividing a respective one of said engaging holes into two hole portions spaced apart from each other along a width direction of said auxiliary plate body, said constriction being formed by two press tabs which are spaced apart from each other along the length direction of said auxiliary plate body and which define therebetween a slot communicating with said two hole portions, each of said hole portions having a length (h1) measured along the length direction of said auxiliary plate body, said slot having a length (h2) measured along the length direction of said auxiliary plate body, each of said press tabs having a length (h3) measured along the length direction of said auxiliary plate body, the length (h1) of each of said hole portions being greater than the thickness (t2) of the outer ring, the length (h2) of said slot being greater than the thickness (t1) of the circular plate but smaller than the thickness (t2) of the outer ring, the length (h3) of each of said press tabs being expressed as $h3=[(t2-t1)/2]\times R$, where R is a value that ranges from 0.7 to 0.95 to limit the length (h3) of each of said press tabs relative to the relationship between the thickness (t1) of the circular plate and the thickness (t2) of the outer ring;

wherein said press tabs of each of said engaging holes are configured to respectively press against the inner annular surfaces of the outer ring of each of the binding members when each of the binding members is inserted into a respective one of said engaging holes through said slot so as to position each of the binding members on said auxiliary plate body; and wherein said auxiliary plate body is configured to be separated from the binding members after the papers to be bound are connected to the binding members by pulling each of the binding members away from the respective one of said engaging holes.

2. The auxiliary binding jig as claimed in claim 1, wherein said auxiliary binding jig is flexible.

3. The auxiliary binding jig as claimed in claim 1, further comprising a plurality of connecting plates extending from one of said long sides of said auxiliary plate body in a direction away from the other one of said long sides and spaced apart from each other along the length direction of said auxiliary plate body, each of said connecting plates including an elongated connecting plate body having a connecting side distal from said auxiliary plate body, a first connecting hole formed in said connecting plate body, and a first slit formed in said connecting side and communicating with said first connecting hole, said first slit having a length measured along a length direction of said connecting plate body, which is parallel to the length direction of said auxiliary plate body, smaller than a diameter of said first connecting hole.

4. The auxiliary binding jig as claimed in claim 3, wherein each of said connecting plates further includes a second connecting hole formed in said connecting plate body spaced apart from said first connecting hole along the length direction of said connecting plate body, and a second slit formed in said connecting side and communicating with said second connecting hole, said second slit having a length measured along the length direction of said connecting plate body smaller than a diameter of said second connecting hole.

5. The auxiliary binding jig as claimed in claim 4, wherein a distance between said first and second connecting holes is not less than 3 mm.

6. The auxiliary binding jig as claimed in claim 3, wherein said auxiliary binding jig is flexible.

* * * * *